United States Patent [19]

Huan

[11] Patent Number: 4,784,100

[45] Date of Patent: Nov. 15, 1988

[54] ELECTRICALLY CONTROLLED ENGINE IGNITION SYSTEM FOR POWER BOOST AND FUEL ECONOMY

[76] Inventor: Chin-Don Huan, No. 5-16, Lane 105, Kao Mei Road, Chiao Tou Li, Ching Shui Chen, Taichung Hsien, Taiwan

[21] Appl. No.: 96,825

[22] Filed: Sep. 10, 1987

[51] Int. Cl.[4] ..... F02D 5/04

[52] U.S. Cl. ..... 123/427; 123/428; 123/602

[58] Field of Search ..... 123/428, 407, 602, 650, 123/651

[56] References Cited

U.S. PATENT DOCUMENTS

| | | | |
|---|---|---|---|
| 3,952,715 | 4/1976 | Van Siclen | 123/602 |
| 4,132,208 | 1/1979 | Yukawa | 123/602 |
| 4,195,603 | 4/1980 | Decker | 123/428 |
| 4,433,280 | 2/1984 | Lindgren | 123/428 |

*Primary Examiner*—Raymond A. Nelli

*Attorney, Agent, or Firm*—Browdy and Neimark

[57] ABSTRACT

An electronically controlled ignition system which services to improve the efficiency of the engine so as to boost up the power and economize fuel consumption, and more particularly relates to an ignition system which is able to be controllably adjusted as to the extent of the ignition spark of the plug and the ignition timing in accordance with the conditions of the automobile, road and the driving habit of a driver. The present system is equipped with a vacuum suction device operably controlled by ignition signals so that the extent of ignition spark of the plugs and the ignition advance can be automatically regulated in accordance with the density of the mixture of air and fuel as well as the engine speed for effecting better combustion and precise ignition timing for the engine so to boost up the engine power and effect fuel economy.

4 Claims, 4 Drawing Sheets

ELECTRICALLY CONTROLLED ENGINE IGNITION SYSTEM FOR POWER BOOST AND FUEL ECONOMY

BACKGROUND OF THE INVENTION

The present invention relates to an engine ignition system adopted for power boost and fuel economy, which mainly comprises a diaphragm, a spring, a cylindrical housing with a variable resistor disposed therein and under the diaphragm and connected to an opening of the venturi tube of the throttle valve so to constitute the vacuum suction means which functions in instant response to the variation of the current of air/fuel mixture in the carburetor by producing suction force of different level on the diaphragm which can make the variable resistor change, effecting the timing actuation of transistors in the present circuit so to determine the charge and discharge time of a capacitor via an ignition signal, thus effecting the period of discharge of the ignition coil so to automatically adjust the extent of the ignition spark and to advance the ignition.

As it is well known that the engine ignition system is employed to provide a high-voltage current for the ignition plug so that spark can be generated across the gap of the plug to ignite the compressed mixture of the air and fuel each time when the piston reaches the top dead center (TDC) in a compression stroke; and the higher the engine speed reaches, the more the ignition is advanced so to give the air/fuel mixture ample time to burn and transmit maximum power to the piston. To effect this kind of ignition advance, generally there are adopted two types of spark-advance mechanisms, centrifugal and vacuum.

In the centrifual mechanism, as shown in FIG. 1, there are disposed two weights that throw out against spring tension as engine speed increases. This movement is transmitted through a toggle arrangement to the breaker cam. This causes the cam to advance, or move ahead, with respect to the distributor drive shaft.

In the vacuum mechanism, as shown in FIG. 2, it contains a spring-loaded and airtight diaphragm connected by a linkage to the breaker plate which is supported on a bearing so that it can turn with respect to the distributor housing. It actually turns only a few degrees, since the linkage to the spring-loaded diaphragm prevents any greater rotation than this.

The spring-loaded side of the diaphragm is connected through a vacuum line to an opening which is on the atmospheric side of the throttle valve when the throttle is in the idling position. There is no vacuum advance in this position.

As soon as the throttle is opened, however, it swings past the opening of the vacuum passage. The intake-manifold vacuum can then draw air from the vacuum line and the airtight chamber in the vacuum advance mechanism. This causes the diaphragm to move against the spring. The linkage to the breaker plate then rotates the breaker plate. This movement carries the contact points around so that the cam, as it rotates, closes and opens the points earlier in the cycle. The spark consequently appears at the spark-plug gap earlier in the compression stroke. As the throttle is opened wider, there will be less vacuum in the intake manifold and less vacuum advance. At wide-open throttle, there will be no vacuum advance at all. The spark advance under this condition will be provided entirely by the centrifugal advance mechanism.

On the magnetic-pick-up distributor, the vacuum advance mechanism is attached to the magnetic pick-up assembly so that this assembly is rotated to provide the vacuum advance.

From the above description of advance mechanisms, it is obvious to see that in correspondance to different engine speed, there is a various advance angle defined. In a typical example, the ignition takes place 8 degrees in advance to the reaching of the piston to the TDC; and at the speed of 1000 rpm, the centrifugal advance does not happen. At the speed of 2000 rpm, the corresponding advance angle is set at 26 degrees.

Generally speaking, the spark at the ignition plug must be generated before the piston reaches the TDC in the compression stroke. The start of the combustion as well as the producing of the pressure is allowable at the end of the compression stroke, during the period of the passing of the piston through TDC and the initial of the power stroke. If a delayed ignition takes place, with the piston having started to move downward, the pressure, produced by the combustion of the mixed air and fuel, can generate less power than it should do. In case the ignition occurs with too much advance, pressure from the combustion of the mixed air and fuel is built up to the peak before the end of the compression stroke, which will cause serious knocking and damage to the engine.

Thus, the operation power and life of the engine is closely associated with the precision of the ignition process, because sudden knocking can create huge impact on the crank shaft, causing serious damage of the bearings or even breaking cylinder parts into pieces.

Recently, more and more newly-built cars have adopted electronically controlled spark advance devices to replace those centrifugal and vacuum advance mechanisms for providing more precise and secure ignition, as shown in FIG. 3, a commonly used electronics type spark advance is illustrated.

However, this kind of electronic advance device is relatively expensive and is difficult to be compatible with the traditional centrifugal and vacuum advance mechanisms in installation when replacing the same by said electronic advance device.

In addition to the advance mechanism, the ignition system is also vital to the efficiency of combustion and ignition.

In a conventional engine ignition process, as one cylinder begins its compression stroke, one edge of the rotary cam in the distributor is moving away from the arm of a contact-point breaker, and a current is produced in the first coil when the contact points are in contact with each other so as to create a magnetic field thereon. Afterwards, the piston compresses the mixed air and fuel to a position of ignition. In the meantime the next breaker point of the cam begins to engage with the arm of the breaker so as to make the contacting points separate, terminating the flow of the current in the main circuit and causing the absence of the existing magnetic field. Thus a high voltage is produced on the second coil, and a spark is created between the spark gap of a plug as a result of the second coil being connected to said plug via the distributor cap as well as the rotor.

In design, the voltage output from the ignition cord can be varied from one to the other in accordance with the practical working condition; in principle, the basic requirement that a spark be produced across the spark gap must be met. For different spark gaps, different voltages are correspondingly defined accordingly. Moreover, the density and volume of the mixed air and fuel fed into the cylinders are varied in accordance with the extent of the opening of the throttle valve as well as the engine speed. To change the voltage of the spark, the high voltage produced in the ignition coil must be simultaneously varied for different working conditions.

The density of the air/fuel mixture in the compression stroke is variable by means of the carburetor, as a result of the ratio of the air and fuel being changed according to various working requirements; for example:

A. Idle speed circuit: denser air/fuel mixture is required to start a "cold" engine, as shown in FIG. 4, the closing of the throttle valve 3A produces a high proportion of fuel in the mixture. It leans out somewhat as it mixes with the small amount of air that gets past the closed throttle valve. The final mixture is still satisfactorily rich for the idle and low speed operation.

B. Low speed circuit: As shown in FIG. 5, when the throttle valve 3A is opened slightly, fuel is thus fed into the intake manifold through the low-speed port. This fuel mixes with the additional air moving past the slightly opened throttle valve to provide sufficient mixture richness for part-throttle low-speed operation.

C. High-speed part-load circuit: When the throttle volve is opened sufficiently, and the wider the throttle is opened and the faster the air flows through the air horn, the greater the vacuum in the venturi. This means that additional fuel will be discharged from the main nozzle (because of the greater vacuum). As a result, a nearly constant air-fuel ratio is maintained by the high-speed circuit from part-to wide-open throttle.

However, the high-voltage output of the ignition coil of the automobile ignition system is almost fixed without variation with respect to the change of the degree of the opening of said throttle valve and the engine speed, thus the extent of the spark produced by the plugs is constantly kept the same without change.

When the engine operates at idle or low speed, the mixture of air and fuel is denser, and the temperature of the plug is accordingly lowered by the fuel to such extent that carbon particles are apt to build up around the insulation of the intermediate electrode of the plug, possibly causing the failure of ignition and extinguishment of the combustion, incomplete combustion and fuel over-consumption.

Otherwise, a "warmer" plug can burn the accumulation of carbon particles away and further prevent the formation of those carbon particles. But an excessively hot plug can produce white or gray bulbous material on the insulation, causing faster wearing out of the plug as well as damage to the electrode. To overcome these problems, a method of controlling the extent of the spark and the pace of the ignition timing in accordance with the density of the mixed air and fuel is disclosed by the present inventor.

SUMMARY OF THE INVENTION

The primary object of the present invention is to provide an electronically-controlled engine ignition system for power boost and fuel economy, which mainly adopts a signal magnifier, wave rectifier, vacuum suction means, transistors, transistor switch that are consecutively electrically connected to each other between the output terminal of the distributor and the ignition coil so that a signal may be magnified to actuate a diaphragm means to vibrate accordingly upward or downward, causing an electrical conducting element to slide in response in abutment with a variable resistor, thus changing the time length of a charging and discharging process of a capacitor, that will then control the actuating transistor and transistor switch to open or close, then the charging and discharging time of the ignition coil is accordingly determined thereby. Thus the extent of the spark and the ignition advance can be regulated in accordance with the density of air/fuel mixture and the engine speed so that a complete combustion process and precise ignition timing can be obtained for output of maximum power from an engine.

The secondary object of the present invention is to provide an electronically controlled engine ignition system for power boost and fuel economy wherein a wave rectifier is adopted to transform the sinusoidal wave into a square wave form for making the ignition signal in a more precise manner.

One further object of the present invention is to provide an electronically-controlled engine ignition system for power boost and fuel economy wherein said vacuum suction means is structured to include a diaphragm, housed in a cylindrical case with a bias spring located on top thereof and an electric conducting means disposed thereunder; and a connecting tube is adopted to couple the vacuum suction means to the venturi tube of the throttle valve; said electric conducting means is an elongate wire-like element bent to consist of two legs which are in contact with a variable resistor and a grounded metal plate respectively, thus the change in the vacuum state in the venturi tube of the throttle valve can actuate said diaphragm to move up and down so as to change the resistance of the variable resistor to effect different operational conditions in the present electrical circuit.

One still further object of the present invention is to provide an electronically controlled engine ignition system for power boost and fuel economy, wherein the extent of the vacuum state in the carburetor is directly associated with the engine speed, i.e., a high-level vacuum state is related to a high speed engine and the present vacuum suction means is associated with a larger resistance and the automatic charging time for ignition spark is in a normal state, the ignition spark is accordingly normal and the ignition is properly advanced; at a low-engine speed, the vacuum suction force is relatively small, the spark generating means has a smaller resistance, the charging time for the ignition coil is prolonged so that the ignition spark is enlarged with the ignition not advanced.

One still further object of the present invention is to provide an electronically-controlled engine ignition system for power boost and fuel economy, wherein the extent of the intensity of the ignition is increased as the engine is at an idle speed or low speed, i.e., the extent of the spark is changed in accordance with the density of the air/fuel mixture.

To better illustrate the structure and operation mode of the present invention, a plurality of diagrams are presented accompanied by a detailed description, in which:

DETAILED DESCRIPTION

Figure 8:
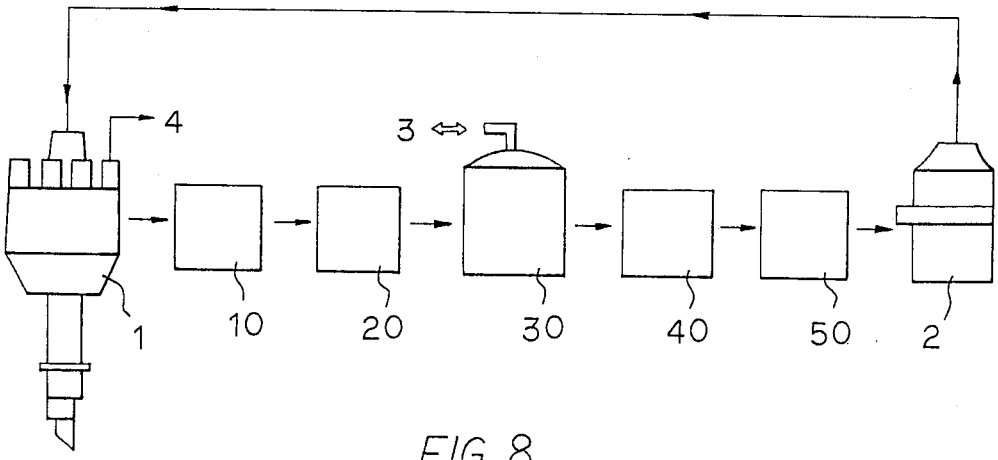
FIG. 8 shows the system installation of the present invention of an electronically-controlled ignition system for power boost and fuel economy.

With reference to FIG. 8, the present invention of an electronically-controlled engine ignition system is characterized in its effect to boost up engine power output and economize fuel consumption. There are arranged, in sequence, a signal magnifier 10, a wave rectifier 20, a vacuum suction means 30, an actuator 40, a transistor switch 50, between an induction output terminal of the distributor 1 from which signal p is delivered, and a ignition coil 2.

Figure 9:
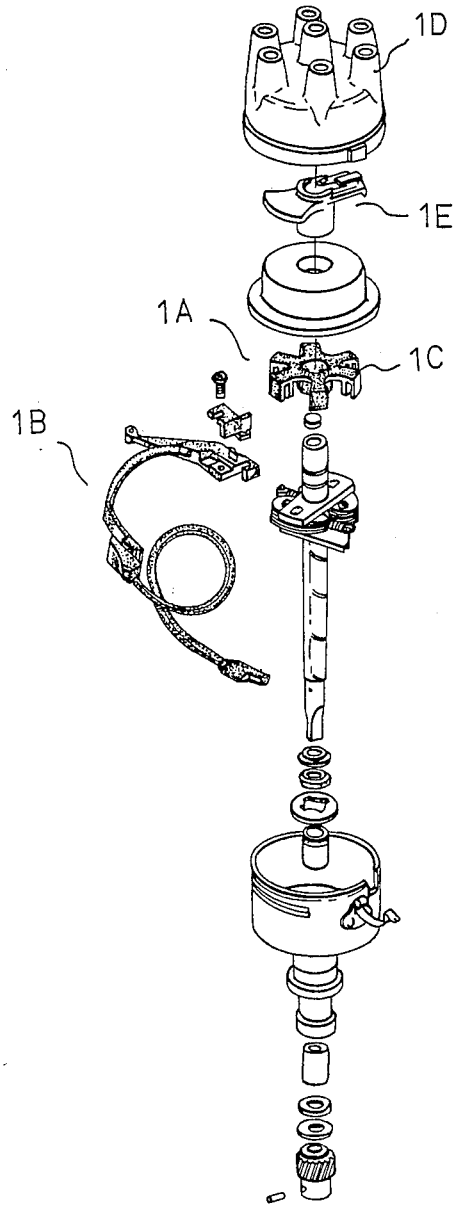
FIG. 9 is a diagram showing the distributor employed in the present invention of an electronically-controlled ignition system.

Distributor 1, as shown in FIG. 9 is a conventional one which is used to produce electrical pulse signals owing to the change of a magnetic field in a coil.

Figure 10:
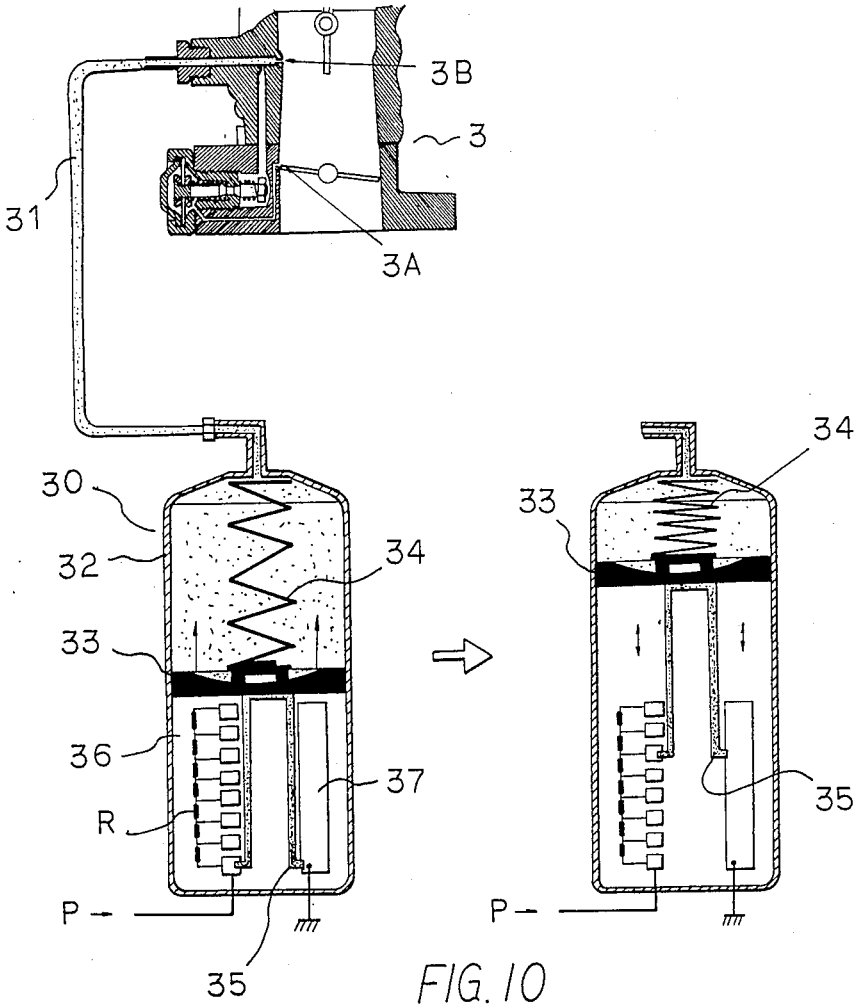
FIG. 10 is a diagram showing the vacuum suction means employed in the present invention of an electronically controlled ignition system.

Signal magnifier 10 is adopted for amplifying the voltage pulse signal p;

Wave rectifier 20 is used to transform said amplified sinusoidal voltage pulse signal p into a square wave so as to make said signal p more precise and stable;

Vacuum suction means 30, as shown in FIG. 10 is coupled to an opening 3B on the wall of the venturi tube of a carburetor 3 by means of a connecting tube 31. A cylindrical housing 32 of said vacuum suction means 30 is used to movably receive a diaphragm 33 therein which is able to move upward or downward according to the change of vacuum state in said venturi tube; on top of said diaphragm 33 is disposed a spring 34, and a pair of conducting legs 35 are also planted thereunder with the left leg being in slidable contact with a plurality of serially-connected resistors 36, and the right leg being in slidable contact with a grounded metal plate 37; thus the movement of said diaphragm 33, caused by the variation of the vacuum state in the venturi tube of said carburetor 3 as a result of the change of the extent of opening of said throttle valve, can produce different resistor values when said left leg moves in contact with different contacts along the serially-connected resistors R; the higher the left leg moves upward, the larger the resistance the variable resistor RL produces.

Figure 11:
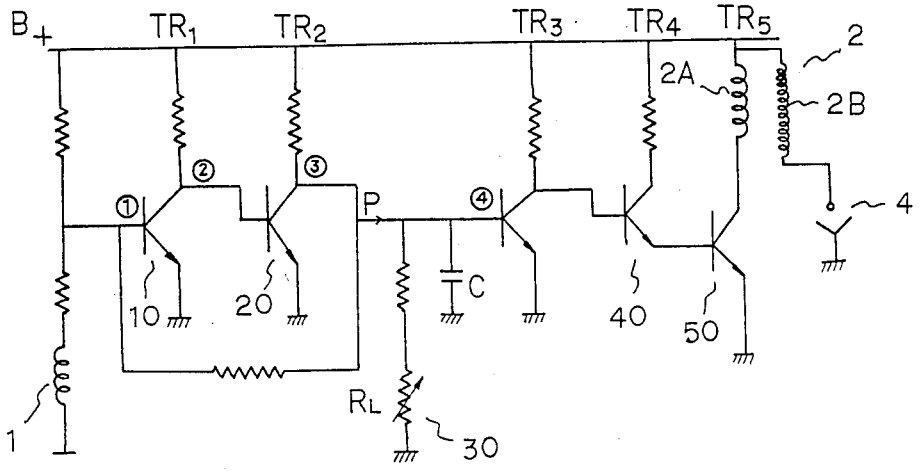
FIG. 11 is the electric circuit diagram of the present invention.

Actuating transistor 40 as shown in FIG. 11 is used to control a transistor switch 50.

Transistor switch 50 as shown in FIG. 11 functions as a switching means and is operated by said vacuum suction means 30 to open or close said transistor so as to determine the time period of charging the ignition coil 2 and the advance angle of ignition.

The present ignition system does not employ conventional centrifugal advance or vacuum advance to make the ignition timing forward, and extent of the ignition spark is also able to be increased by adoption of the present system. Said vacuum suction means 30 is designed and installed to effect the ignition advance and enlargement of the ignition spark. As shown in FIG. 11, when the amplified and rectified square wave of an induced signal p is transmitted through said vacuum suction means 30, in the case of the vacuum suction force in the carburetor 3 being small, causing said diaphragm 33 to locate at a lower position as shown in FIG. 10, thus the electrical conducting means under said diaphragm 33 is in association with a small resistance in RL, and the capacitor C can only obtain a smaller bias voltage across the parallel connected resistor RL; until the capacitor C is charged to reach the working voltage to actuate the transistor TR3, accordingly the transistor TR4 is made to work, and the transistor TR5 is cut off, and the ignition coil 2 provides for a high voltage for the ignition plug 4; after the discharge of said ignition coil 2 is completed, the capacitor C terminates instantly its discharge process, causing transistor TR3 to close, and the transistors TR4 and TR5 starting to function, the ignition coil 2 is then recharged once again.

Therefore, the longer the ignition coil is charged, the higher the voltage it generates, and so the extent of the ignition spark of said plug 4 is accordingly increased. In other words, the smaller the resistance of resistor RL is, the lower the bias voltage becomes, and the longer it takes to charge the capacitor C, the extent of the ignition spark of said plug 4 is increased in accordance with the prolongation of the charge of said ignition coil 2, and the ignition time is delayed.

It appears clear that the present invention adopts a movable diaphragm in a vacuum suction means 30 to change the resistance of a resistor RL in accordance with the driving conditions so that the extent of the ignition spark and the ignition timing can be accordingly altered.

At an idle speed, the air/fuel mixture is very rich so that an intensified spark is required to ignite the mixture to to effect an ideal combustion; and the throttle valve 3A of said carburetor 3 is almost in a closed state so that the vacuum suction force therein is relatively small, and said diaphragm 33 in said cylindrical casing 32 is caused to move slightly upward or even not to move at all, as shown in FIG. 10, thus a small resistance is defined thereby, prolonging the charge time of said ignition coil 2 and producing a relatively large spark for meeting the idle speed ignition requirement.

Figure 5:
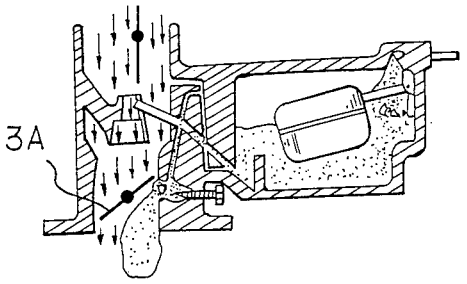
FIG. 5 is a diagram showing the low-speed circuit.

As shown in FIG. 5, when the engine is operating at a low speed, the air/fuel mixture is still very rich, and the vacuum state in said carburetor 3 is slightly increased and so is the related resistance of resistor RL, and a "larger" spark is still obtainable. The extent of the ignition spark is changed in accordance with the density of the air/fuel mixture, and the temperature of the spark plug 4 is properly balanced thereby so as to avoid overheating thereon which can produce excessive exhaust gas. Therefore, the cars with the present invention are able to move at a low speed in a city area with fuel economy and without generating too much exhaust gas.

Figure 6:
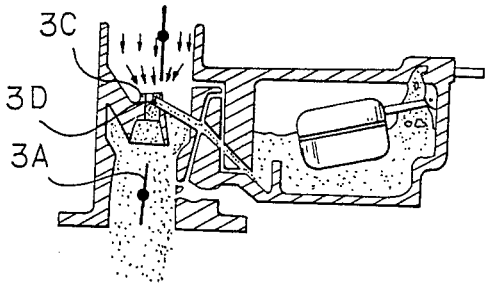
FIG. 6 is a diagram showing the high-speed circuit.
Figure 7:
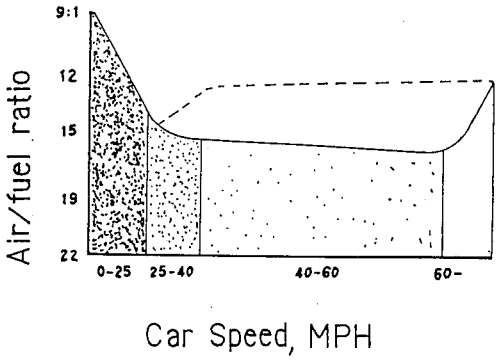
FIG. 7 is a diagram showing the air/fuel ratio of the carburetor system of the engine.

As further shown in FIGS. 6 and 7, at a high speed, the vacuum suction force is relatively large, and the air/fuel mixture is relatively thinner (no intensified ignition spark is required), and the diaphragm 33 is actuated to move upward so that the resistance of resistor RL is increased, said capacitor C is quickly charged to reach a working voltage, and the charging time for said ignition coil 2 resumes to a normal state, and the ignition is advanced to cope with a fast operating engine.

Figure 12:
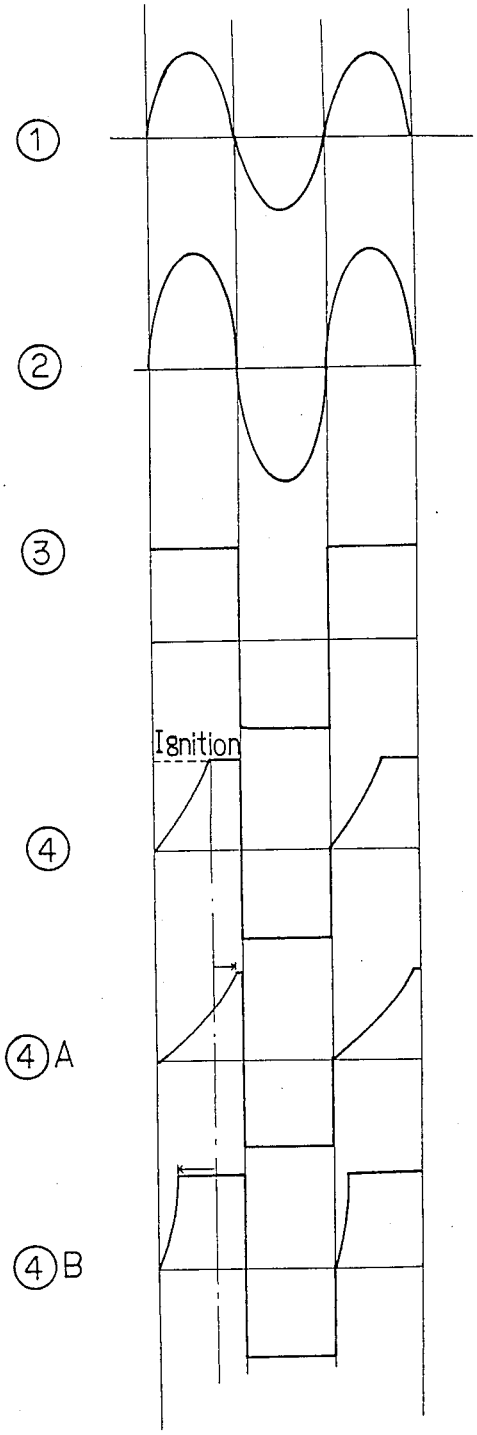
FIG. 12 is a diagram showing the wave forms of the present ignition system.

A wave form diagram is illustrated in FIG. 12 to better explain the present invention: (in accordance with the wave form change in FIG. 11)

(1) is an induced signal from the distributor

(2) is an amplified signal;

(3) is a square wave after the rectification by said wave rectifier 20.

(4) is a diagram showing a wave form which is associated with a non-advanced or non-delayed state with an ignition position indicated.

Figure 1:
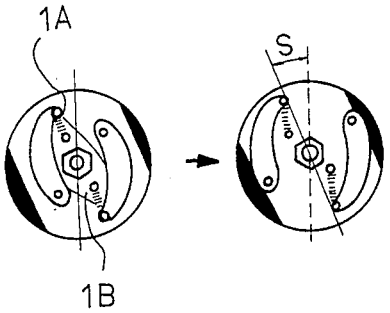
FIG. 1 is a diagram showing the conventional centrifugal advance mechanism.
Figure 2:
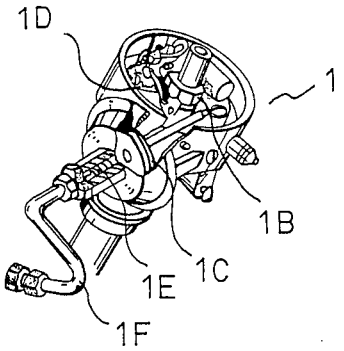
FIG. 2 is a diagram showing the conventional vacuum advance mechanism.
Figure 3:
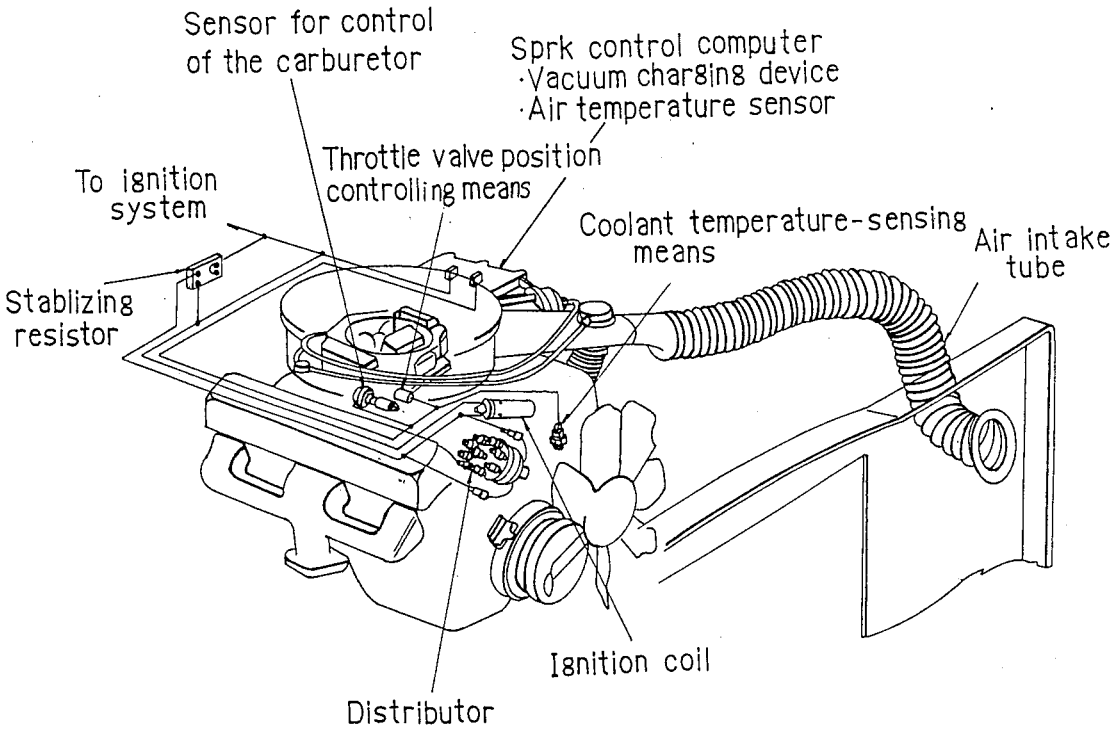
FIG. 3 is an electronically controlled advance device.
Figure 4:
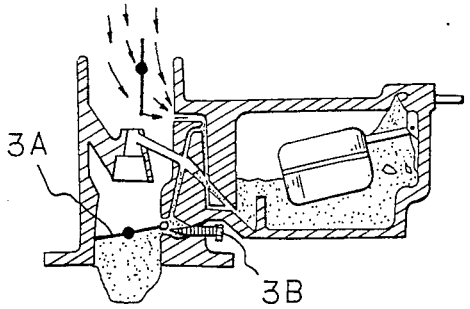
FIG. 4 is a diagram showing the idle-speed circuit.

As shown in FIG. 4(A), the change of the wave form illustrates a delay of the ignition and the increase of the extent of the ignition spark with the merit of no knocking taking place, when the air/fuel mixture is relatively rich in the cases of fast acceleration, slope climbing, heavy load and down slope driving.

As shown in FIG. 4B the ignition is advanced, the charging time of said ignition coil is shortened and the spark is smaller so as to function in conformity with the normal operation of an engine in which no intensified sparks are necessary.

It is now clearly shown that the present invention adopts a simple and inexpensive device to readily effect precise ignition and increase the extent of the ignition spark at a proper moment so as to improve the combustion efficiency and power output of an engine.

What is claimed is:

1. An electronically controlled ignition system for power boost and fuel economy connected between an induction output terminal of a distributor means and an ignition coil, including a vacuum suction means connected to a venturi throat of a carburetor, the vacuum suction means comprising:

a housing;

a connecting tube means to connect said housing to the venturi throat of the carburetor;

a diaphragm movably mounted in said housing for upward and downward movement which movement is actuated by a change of vacuum state in the carburetor;

a spring disposed on one side of said diaphragm;

a pair of conducting legs disposed on the other side of said diaphragm and movable with said diaphragm;

a variable resistance means including a plurality of elongate serially connected variable resistors with one of said pair of conducting legs in slidable contact therewith to contact different parts along said variable resistors for effecting a change of resistance value of said variable resistance means;

a grounded metal plate with the other of said pair of conducting legs in slidable contact therewith.

2. The electronically controlled ignition system of claim 1 further comprising a signal magnifier connected to the induction output terminal of the distributer means to receive a signal therefrom and amplify said signal;

a wave rectifier receiving an amplified signal from said signal rectifier and transforming said amplified signal into a square wave;

said vacuum suction means receiving the signal from said wave rectifier and varying it in accordance with said variable resistance means;

transistor switching means to determine the time period of charging the ignition coil and the advance angle of ignition connected to said vacuum suction means.

3. The electronically controlled ignition system of claim 2 wherein said transistor switching means includes a capacitor in parallel with said variable resistance means;

transistors actuated in their functioning by said capacitor reaching a working voltage of at least one of said transistors.

4. The electronically controlled ignition system of claim 1 wherein said variable resistance means has increasing resistance as said diaphragm moves upward and decreasing resistance as said diaphragm moves downward varying the time of charging the ignition coil and the voltage generated by the ignition coil.

* * * * *